US005809805A

United States Patent [19]

Palmer et al.

[11] Patent Number: 5,809,805

[45] Date of Patent: Sep. 22, 1998

[54] WARP/KNIT REINFORCED STRUCTURAL FABRIC

[75] Inventors: Raymond J. Palmer, Newport Beach, Calif.; Gert Wagener, Emsdetten, Germany

[73] Assignee: McDonnell Douglas Corporation, St. Louis, Mich.

[21] Appl. No.: 707,016

[22] Filed: Sep. 3, 1996

[51] Int. Cl.[6] ..... D04B 21/14

[52] U.S. Cl. ..... 66/84 A; 66/203; 66/190; 66/192; 66/195; 442/314

[58] Field of Search ..... 66/84 R, 83, 84 A, 66/203, 190, 192, 195; 442/305, 312, 313, 314

[56] References Cited

U.S. PATENT DOCUMENTS

| | | |
|---|---|---|
| 4,484,459 | 11/1984 | Hutson . |
| 4,550,045 | 10/1985 | Hutson . |

FOREIGN PATENT DOCUMENTS

| | | |
|---|---|---|
| 27 07 001 A1 | 9/1977 | Germany . |
| 33 04 345 A1 | 8/1984 | Germany . |
| WO 96/10666 | 4/1996 | WIPO . |
| WO 98/10128 | 3/1998 | WIPO . |

*Primary Examiner*—C. D. Crowder
*Assistant Examiner*—Larry D. Worrell, Jr.
*Attorney, Agent, or Firm*—Bell Seltzer Intellectual Property Law Group of Alston & Bird LLP

[57] ABSTRACT

An improved warp/knit stitch reinforced multi-axial non-crimp layered fabric sheet used in structural applications, as for example, in aircraft and water applications, e.g. the skin of an airplane wing or fuselage structure, in water applications, e.g. skins of surfboards and boats, and in other areas where high strength and relatively light weight is required. The fabric is comprised of a plurality of plies facewise disposed upon one another and knitted or stitched to form a structural sheet. Each fabric ply is made of strands of aligned structural fibers which can be later impregnated and even pre-impregnated with a resin curable matrix. The improved sheet is formed by applying unidirectional non-crimp and non-woven plies of different angular relationship to one another, e.g. a +45°, a 90° and a −45° ply and locating 0° plies in essentially any position in the ply arrangement such that the 0° ply can be on the bottom of the sheet, on top of the sheet, or interposed between plural ply layers of the sheet. The sheets are then knitted or stitched together to make a stack of multi-axial fabric layers. The fiber weight and thickness can also be varied throughout the sheets by using plies of different thicknesses or differing weights of fibers. Moreover, the percentage of a certain type of fiber in a particular ply can be varied. In addition, damage tolerance can be built into the cured laminate. Further, doublers and local area reinforcements can also be included in the sheet. In addition, a warp/knit, or warp/stitched fabric may be made to a desired width without otherwise affecting the structural properties of the sheet. An apparatus and a method for producing the fabric sheets is also disclosed.

54 Claims, 7 Drawing Sheets

FIG. 3
8-PLY SHEET CONSTRUCTION
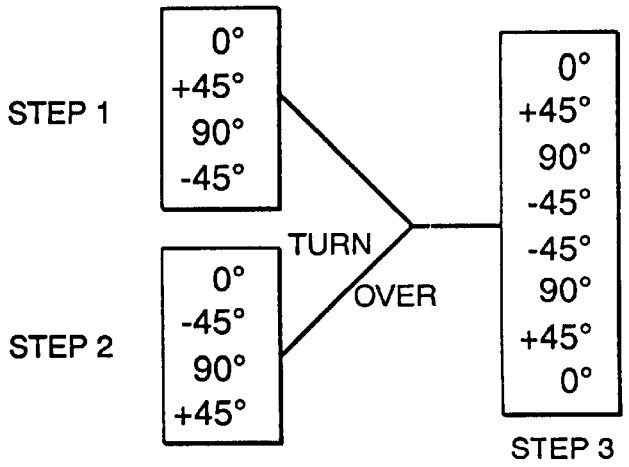
FIG. 3A
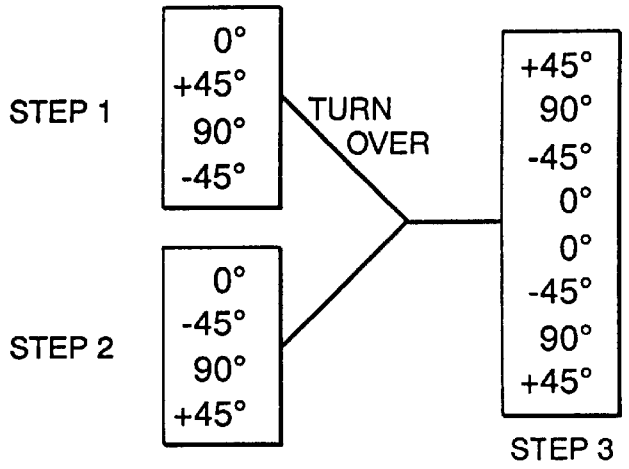
FIG. 3B
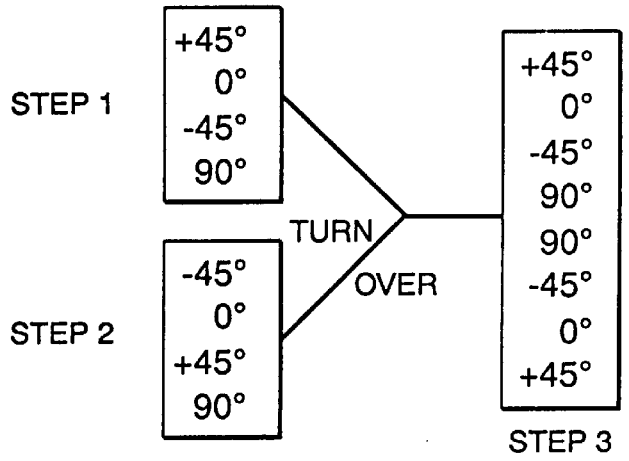
FIG. 3C

PRODUCTION OF WIDE FABRIC

PRODUCTION OF WIDE FABRIC SIMILAR WRAP/KNIT

WARP/KNIT REINFORCED STRUCTURAL FABRIC

BACKGROUND OF THE INVENTION

1. Field of the Invention

This invention relates in general to certain new and useful improvements in fabric sheets used in structural applications and more particularly to an improved warp/knit or warp/stitch reinforced fabric sheet made from a desired number of plies with one or more 0° plies located anywhere in the stack of plies and with localized reinforcement, damage tolerance, and other improved characteristics not found in prior art structural fabric sheets.

2. Brief Description of Related Art

Many structural fabrics are currently made with the warp/knit fabric weaving process. Fabrics of this type are usually comprised of sheets of reinforcing fibers, such as carbon, nylon, glass, etc. and tows, which are later impregnated with a curable matrix, such as many polyesters, phenolics, epoxies, polyimides and the like. Sheets of this type are frequently employed in the manufacture of aircraft parts, as for example, skins of a fuselage and skins of wings. Also these fabrics find a variety of uses in other applications.

There are several inherent limitations in the presently available processes for producing warp/knit fabrics. Typically, the commercially available warp/knit processes are limited to two, three, or four plies and in some cases five plies. There have been certain proposed processes where multi-ply sheets have prepared up to a maximum of eight plies. However, the commercially available processes are typically designed only for two, three, or four plies with four plies being the standard.

In essentially all commercially available processes and apparatus and proposed processes and apparatus which are used for producing a warp/knit or warp/stitch sheet, the 0° ply layer is almost inevitably limited to the upper surface of the sheet. This is due to the fact that the various other plies are applied at stations along a traveling belt with locating pins and held in place under tension on the sides of the belt. The angulated plies such as, for example, a +45° ply, a −45° ply, or a 90° ply, or for that matter other angulated plies, e.g. a 60° ply, are typically held in place and where the fibers are temporarily held in a properly aligned position by means of wrapping fibers forming part of the plies about locating pins on each of the longitudinal sides of a traveling belt. However, in all of the prior art machines, there has not been any effective means for holding the fibers of a 0° ply in place, except on the upper surface thereof. The 0° ply is typically the last ply which is applied from a warp spool, particularly when using a Liba or a Malimo type warp/knit machine or other stitching machine to make the fabric. The space between the 0° ply and the stabilization thread by the warp/knit process is short such that the 0° ply does not have sufficient time to disorient.

Another one of the problems inherent with currently available warp/knit produced fabrics in the production of a quality product is the fact that the fabric is limited to a width capable of being produced by the available warp/knit machines.

The current LIBA warp/knit machines will produce useful fabric up to of 62 inch width. A prior art machine known as the Carl Mayer machine is limited to 60 inch width fabric production with only four layers. The Malimo machine uses a cross over of 90° and 45° plies and this results in somewhat lower strength.

There is no effective means for splicing together individual sheets without resultant thickness variation and lower strength. In the prior art, attempts have been made to splice individual sheet segments together in order to achieve a composite sheet of a selected width. However, it has been found in essentially all cases that there is either substantially reduced strength or increased weight and thickness in the overlap area of the splice.

In addition to the foregoing, there is little or no possibility of allowing for thickness or local damage tolerance in the prior art sheets. In essence, there is no provision on a conventional warp/knit machine to provide areas of increased thickness or local build-up.

The art of warp knitting a fabric is best exemplified by U.S. Pat. No. 4,550,045, dated Oct. 29, 1985 to Harold K. Hutson for Biased (45°) Multi-Layer Structural Fabric Composites Stitched In A Vertical Direction. In the Hutson patent, a warp/knit fabric machine is at least schematically illustrated and shows the application of 90° plies as well as −45° plies and +45° plies and which are vertically stitched together. However, the Hutson patent also exemplifies the limitations in the prior art apparatus and process in that in his preferred embodiment only four plies are provided, which include the +45° ply, the 90° ply, the −45° ply and an overlay of a 0° ply. However, in all cases the overlay is on the upper surface of the plurality of plies, although the Hutson patent also shows that a large number of plies can be applied in a structural fabric. The process of accomplishing this result, even if at all achievable, is inefficient, not practical on a commercial basis and can at least be described as "clumsy".

A stitched fabric with vertical stitching is also taught in German Patent No. 8194 dated Feb. 3, 1949 to Heinrich Mauersberger. This reference disclosed a textile fabric material which is produced by warp knitting. Moreover, in the Mauersberger patent, and also in the aforesaid Hutson patent, vertical stitching is used between the various layers of fibers.

There has also been a process in which a polyester knit thread was used to hold plural facewise disposed plies together. However, this knit thread does little, if anything at all, to improve damage tolerance. Its primary function is to stabilize the warp/knit fabric.

There has been a need for a structural fabric sheet and particularly for an apparatus and a process for producing a structural fabric sheet using a warp/knit machine or a warp/stitching machine in which more than eight plies can be obtained and moreover, there has been a need for a structural fabric sheet of this type in which one or more 0° plies can be located in essentially any desired location on the sheet. Further, there has also been a need for a structural fabric sheet as well as an associated apparatus and method for producing this sheet in which localized damage tolerance can be provided in selected areas and where reinforcement in the sheets can be provided in desired areas and further where doublers and the like can be incorporated in the sheets.

In addition there is a need for a fabric as well as a machine to make such a fabric that controls the modules of elasticity (stiffness) of the fabric in certain directions by use of a hybrid fiber combination, as for example Fiberglass and carbon fiber in specific orientation. Finally, there is need to make very wide fabric for manufacture of very large (wide) parts without splices.

OBJECTS OF THE INVENTION

It is, therefore, one of the primary objects of the present invention to provide a warp/knitted or stitched structural multi-ply fabric sheet which is non-crimped and non-woven and which is capable of being used in structural applications in a highly efficient manner and which can be tailored to meet desired specifications in such selected applications.

It is another object of the present invention to provide a warp/knitted or stitched structural multi-ply fabric sheet in which there are a plurality of plies including one or more 0° plies and where the 0° ply or plies may be located essentially anywhere in the arrangement of plies.

It is yet another object of the present invention to provide a warp/knitted or stitched structural multi-ply fabric sheet utilizing high strength knit thread and with dramatically increased damage tolerance.

It is a further object of the present invention to provide a warp/knitted structural multi-ply fabric sheet in which there may be three or more plies facewise disposed upon one another and made from stacks of plies knitted or stitched together and where some of the plies are angularly arranged with respect to other of the plies.

It is an additional object of the present invention to provide a warp/knitted or stitched structural multi-ply fabric sheet in which fibers of different weight or thicknesses or fibers of different modulus may be included within the sheet.

It is also an object of the present invention to provide a warp/knitted or stitched structural multi-ply fabric sheet which is non-woven and in which stiffener portions may be located in the sheet and which may also include doublers or localized reinforcement for particular applications.

It is another salient object of the present invention to provide a method of producing a thick multi-ply warp/knitted or stitched structural fabric sheet which is non-woven and which can be operated with conventional warp/knitting machines and with modified warp/knitting machines.

It is a salient object of the present invention to provide a process for producing a wide spliced warp/knitted or stitched structural fabric sheet in which several layers of plies are warp/knitted or stitched together in side by side relationship without any substantial loss of mechanical properties at a splice joint.

It is still another object of the present invention to provide both a structural warp/knitted or stitched fabric sheet as well as a method of making the same which is highly effective and which is capable of providing enhanced mechanical properties and freedom of location of local areas of reinforcement.

It is yet another object of the present invention to provide an improved apparatus for producing a warp/knit stitch reinforced structural fabric sheet.

It is still an additional object of the present invention to provide a non-woven, non-crimped fabric with a balanced fiber pattern which eliminates or minimizes warpage when cured.

With the above and other objects in view, our invention resides in the novel features of form, construction, arrangement and combination of parts and components presently described and pointed out in the claims.

SUMMARY OF THE INVENTION

The present invention relates in general terms to a unique warp/knit process as well as warp/knitted structural multi-ply fabric sheets with structural fiber and which fibers are non-woven and non-crimped. These sheets are capable of being used in desired structural applications and capable of being tailored to selected specifications including localized reinforced areas, desired thicknesses, a desired number of plies, desired weight, desired fiber orientation, desired stiffness or strength, and the like.

In one aspect, the warp/knitted or stitched structural multi-ply fabric sheet is comprised of a plurality of angularly arranged plies other than 0° plies, along with 0° plies and which are disposed upon one another in desired angular relationships and where the angular relationships of at least one of these plies may well be different than at least one of the other plies. In addition, a 0° ply is located on a surface of the fabric sheet in a position, if desired, other than on the upper surface.

The term warp/knitted or warp/knitting is used in a broad sense to include the concept of warp stitching since the two are really closely related. Although knitting involves the actual tying of the threads together, certain stitching processes also use two threads as for example, in lock stitching. Thus, as used in the present invention, warp stitching is encompassed by warp knitting and warp knitting is encompassed by the process of warp stitching.

In a more preferred embodiment of this aspect of the invention, the plies may include, for example, a +45° ply, a −45° ply and a 90° ply, as well as a 0° ply. In the prior art, the 0° ply was essentially limited to the upper surface of the stack of plies. However, in the case of the present invention, the 0° ply can be located on the lower surface of the fabric sheet or in between any of the other plies and is not specifically limited to a position on the upper surface of the plies.

In another aspect of the invention, there is a warp/knitted structural multi-ply fabric sheet which is non-woven and which is comprised of at least seven plies facewise disposed upon one another and where certain of the plies are angularly arranged with one another and the angular relationship of certain plies is different than that of certain other plies. There may also be at least one 0° ply in this arrangement of stacked and secured plies. In accordance with the present invention, it is possible to produce a warp/knit multi-axial fabric with no 0° plies, as for example, a +45°, −45°, 90°, −45°, +45° ply arrangement.

It is also possible to produce a balanced fiber pattern ply arrangement in order to eliminate or otherwise minimize warpage in a cured panel. The balanced pattern, when employed, uses parallel outer layers, as for example, where both of the outer layers are +45° plies. Moreover, each of the next groups of plies are parallel. As an example, in a seven ply fabric, the plies could have a pattern of +45°, −45°, 0°, 90°, 0°, −45°, +45°.

Thus, it can be seen that it is possible to apply essentially any number of plies to a stack in order to make a structural fabric sheet. The present invention is not limited to any particular number of plies and is capable of producing multi-ply sheets well in excess of nine ply sheets, which is greater than the maximum number of eight plies in any effectively produced prior art sheet. There have been proposals to make laminated sheets of more than nine plies in the prior art as for example, in the aforesaid Hutson patent. However, these proposals relied upon a single stitching of all sheets together. Thus, while the Hutson patent proposes a 54 ply sheet, it also proposes laying 54 plies upon one another and simultaneously stitching all such plies together in a single operation.

This type of stitching operation with 54 plies is not only impractical due to the difficulty in maintaining the plies in marginal registration, but it requires the capacity of a warp knit fabric machine which is not commercially available. In addition, it requires needle sizes and needle strokes which are capable of stitching 54 individual plies. Consequently, and while in theory, it would be desirable to achieve such a result, the means of achieving the result of a 54 ply sheet in the Hutson patent is not only impractical, it may not even be commercially possible. In accordance with the present invention, however, the number of plies incorporated in any sheet is not necessarily limited by the length of the knit needles.

In the present invention, individual stacks of fiber sheets as for example, seven plies in each individual stack are prepared. Thereafter, two or more of these stacks can be stitched together in individual arrangements. For example, two 7 ply stacks can be stitched together and two other 7 ply stacks can be stitched together to create two stacks each having 14 plies. Thereafter, the stacks of 14 plies can be stitched together. Not only is this a far more efficient operation, it does not necessarily require modification of existing warp knit fabric machines. The number of plies incorporated in any sheet is only limited by the length of the traveling belt, the number of fiber application stations, and the length of the knit needles as well as the lift of the needles sufficiently to clear the final fabric sheet.

In addition to the foregoing, the present invention provides both unique processes and unique apparatus for producing the aforesaid fabric sheets. The invention also provides several unique methods of achieving a 0° ply freedom. In this way, the various plies can be arranged relative to one another and the 0° ply included in any desired orientation within the various other plies and then introduced into a warp/knit machine for ultimate securement of the plies together in a stitching operation.

It is also possible, in accordance with the present invention, to provide areas of doublers or localized reinforcement. In this way, it is possible to provide reinforced sheets having reinforced areas to accommodate particular end use applications.

In addition to the foregoing, it is also possible to vary the thickness and the weight of a ply in order to control the desired percent of a particular fiber orientation. Thus, some plies may be formed of fibers which are thicker or have a denser weight than the fibers used in other of the plies. In addition, it is also possible to use fibers of differing weights and differing thicknesses in a particular individual ply. In this way, it is also possible to account for potential damage tolerance in a structural fabric sheet. A damage tolerance can be achieved by adding to a laminate made from a warp/knit fabric, specialized penetrating Z-axis thread for securing the various fabric plies together.

In each of the aforesaid embodiments, when the plies of the fabric sheets are disposed upon one another, they are then secured together by Z-axis fibers and in effect knitted into a desired multi-ply structural sheet. In this case, the sheet could also be constructed with differing properties such that the sheet may be made with e.g. glass fibers and also with carbon fibers where the carbon fibers provide a higher degree of stiffness reinforcement in certain areas than do the glass fibers.

The stiffness or modulus of elasticity of a fabric may be varied in separate directions with a hybrid mix, as for example all fibers of one type, e.g., fiberglass in one direction and different fibers, e.g. all carbon fibers, in another direction.

The fabric sheets may be ultimately impregnated with a suitable curable resin matrix in order to provide the desired laminate mechanical properties upon curing of the resin matrix. Any of a number of thermoplastic or thermosetting resin materials known in the art may be used for this purpose.

The present invention further provides a process for producing a spliced warp/knitted structural fabric sheet in which there is no significant loss of strength in the areas of splicing of individual sheet segments together. This allows for exceedingly wide sheets to be produced and in fact, allows for production of sheets which can have a width greater than a normal Liba multi-axial warp/knit fabric machine. High performance multi-axial warp/knit fabric made by the Liba equipment is limited to 62 inches, as aforesaid, as a maximum width. In the Malimo machine, maximum width up to 150 inches can be produced. However, fiber arrangements are usually at 88° to 92° with crossovers of 90° fibers, although 90° fibers can be used. This necessarily results in somewhat lower mechanical properties or otherwise quality of material.

One of the desired procedures for producing a very wide fabric is to use side by side conventional Liba warp/knit machines. These machines are constructed so as to provide zero degree plies along with plus and minus 45° plies overlapping the first set of plus and minus 45° plies. These plies are then tied together on the Malimo machine with 88° to 92° fibers which are knitted from side to side such that all plies are secured together in a fixed position, to thereby provide a wide fabric.

Based on the foregoing, it can be seen that a wide number of embodiments of warp/knitted structural multi-ply fabric sheets can be obtained in accordance with the present invention and that the present invention provides several processes capable of producing such multi-ply structural fabric sheets. In addition, apparatus for producing the desired warp/knit structural multi-ply fabric sheets is disclosed. However, only a limited number of the various versions of the multi-ply warp/knitted structural fabric sheet are shown and for that matter only a limited number of the processes and apparatus for producing the same are shown and described herein.

The present invention possesses many other advantages and has other purposes which may be made more clearly apparent from a consideration of the forms in which it may be embodied. As indicated, only a limited number of the embodiments of the structural fabric sheets and the associated apparatus and methods are shown. This limited number of sheets and the apparatus and methods are described in further detail in the following detailed description and illustrated in the accompanying drawings. However, it should be understood that this detailed description and the accompanying drawings are only for purposes of illustrating the general principles of the invention and are therefore not to be taken in a limiting sense.

BRIEF DESCRIPTION OF THE DRAWINGS

Figure 1:
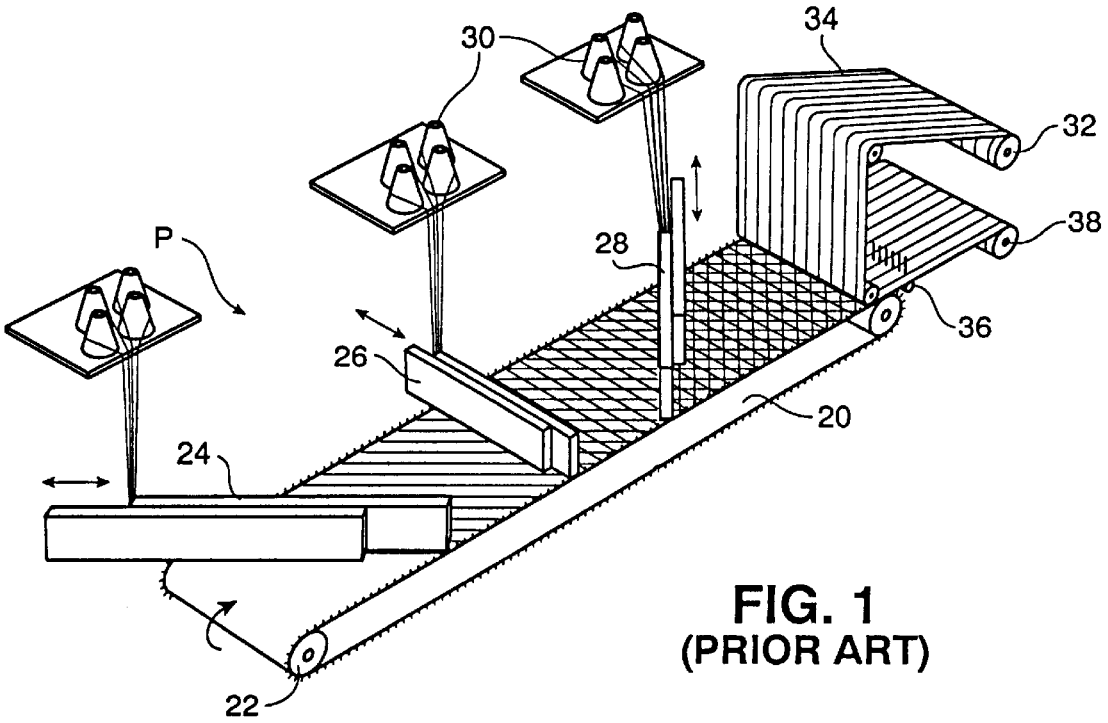
FIG. 1 (PRIOR ART)
Figure 2:
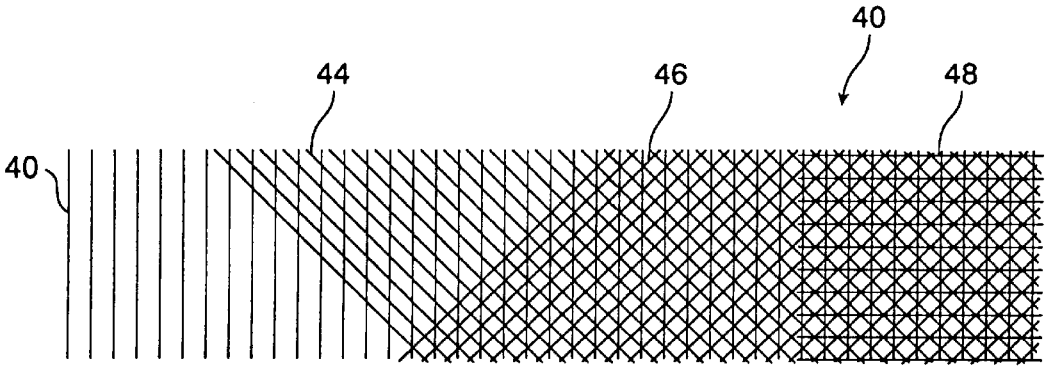
Figures 4, 5:
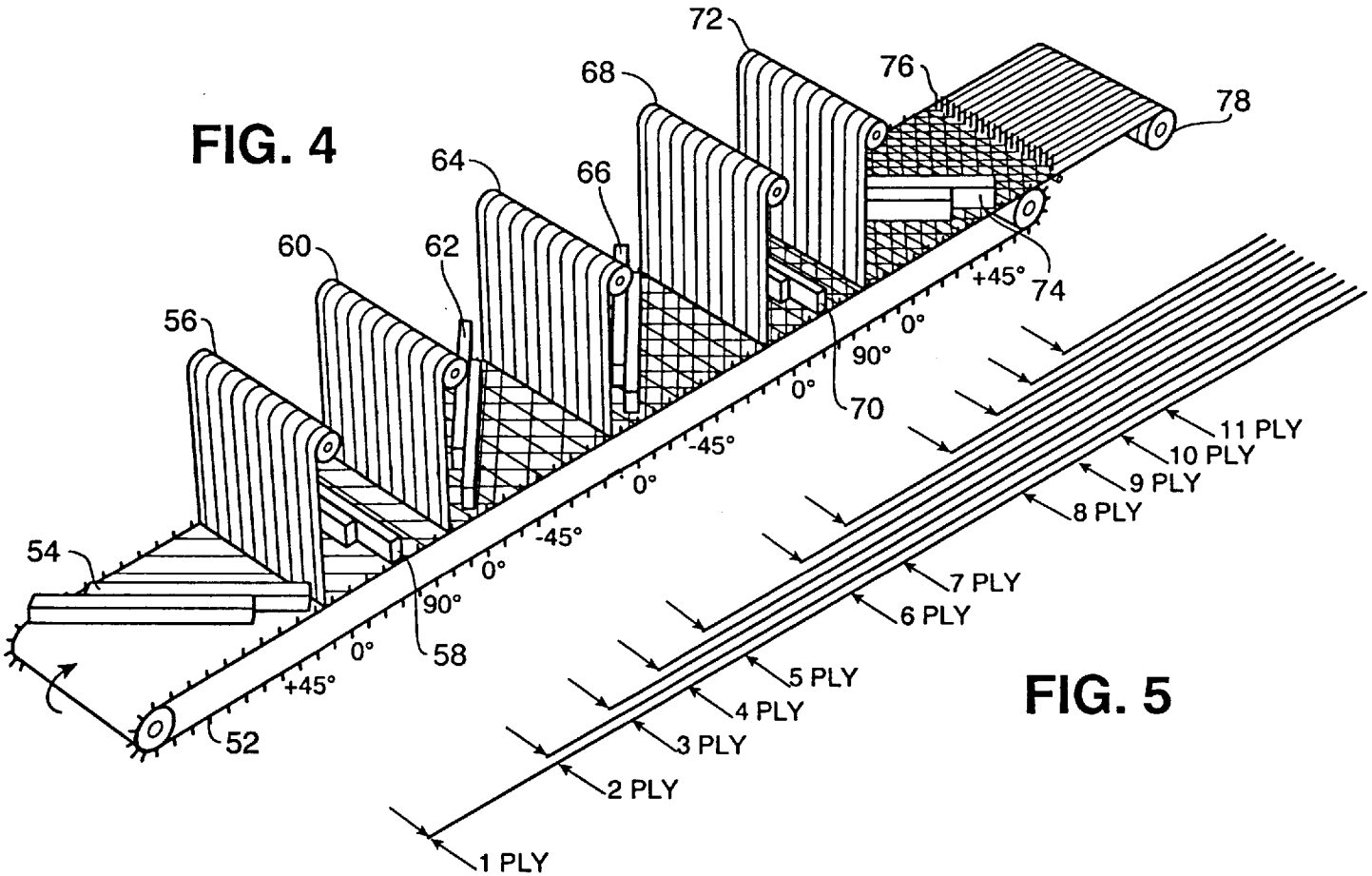
Figure 6:
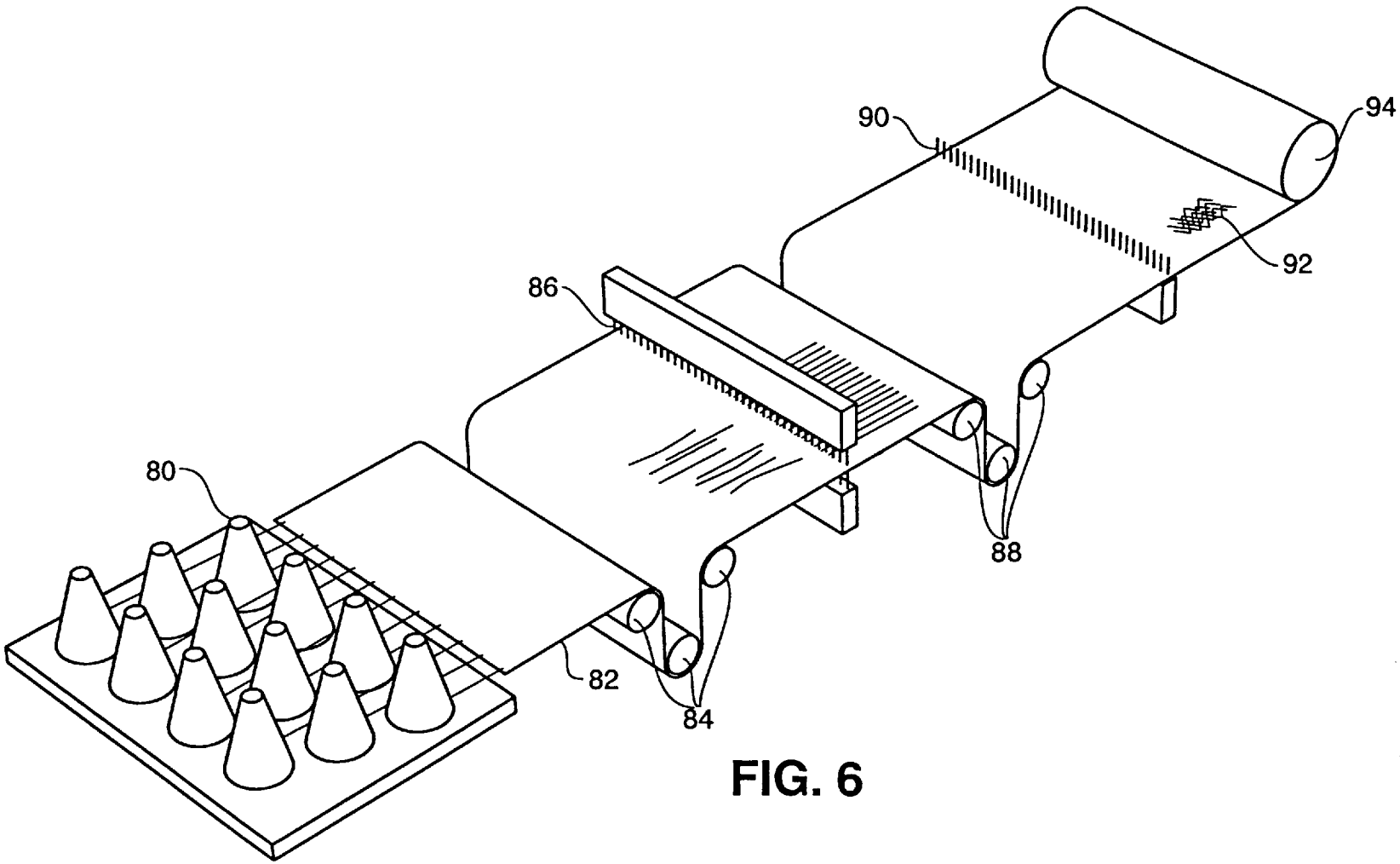
Figure 8:
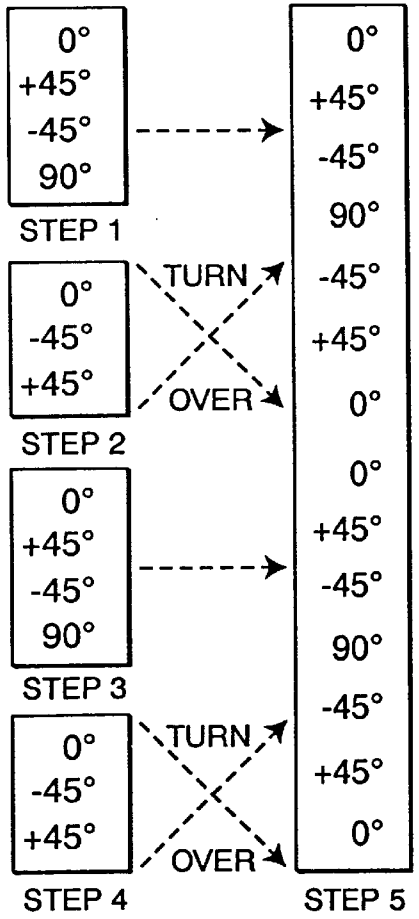
Figure 7:
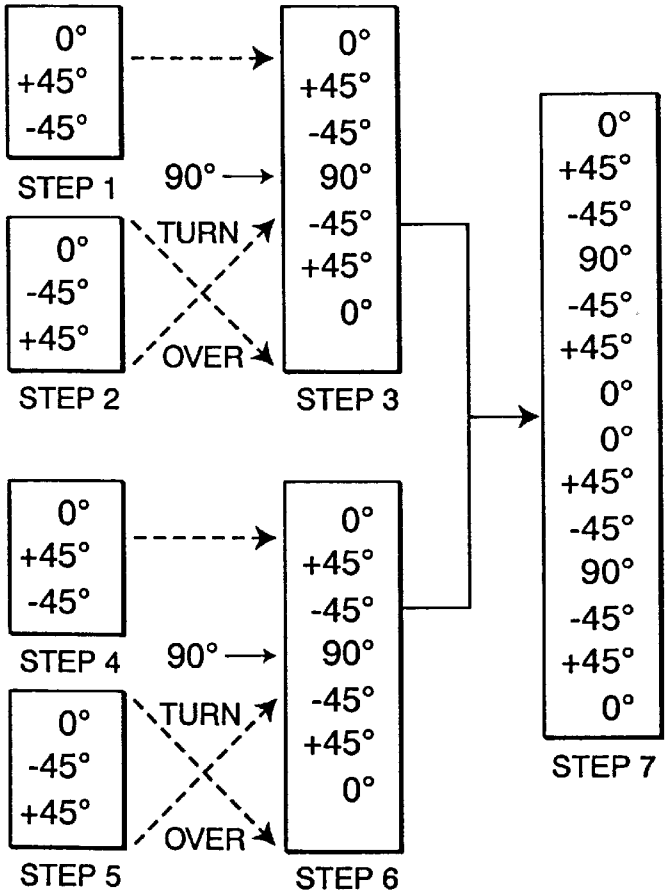
Figure 9:
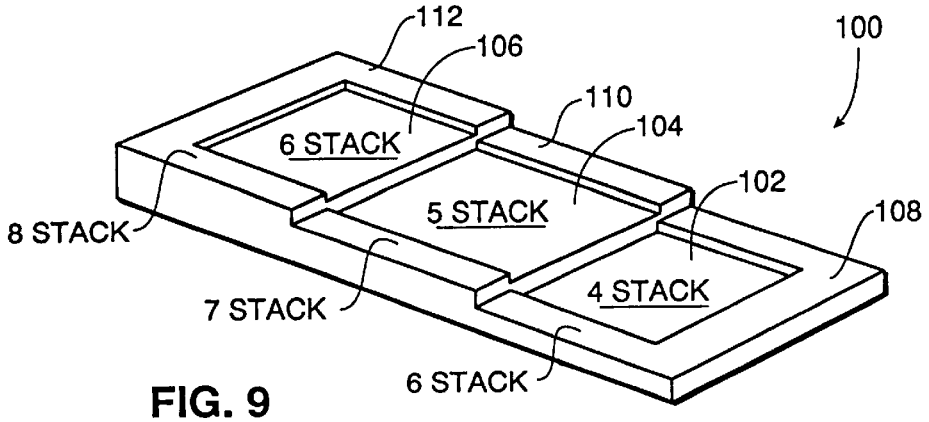
Figure 10:
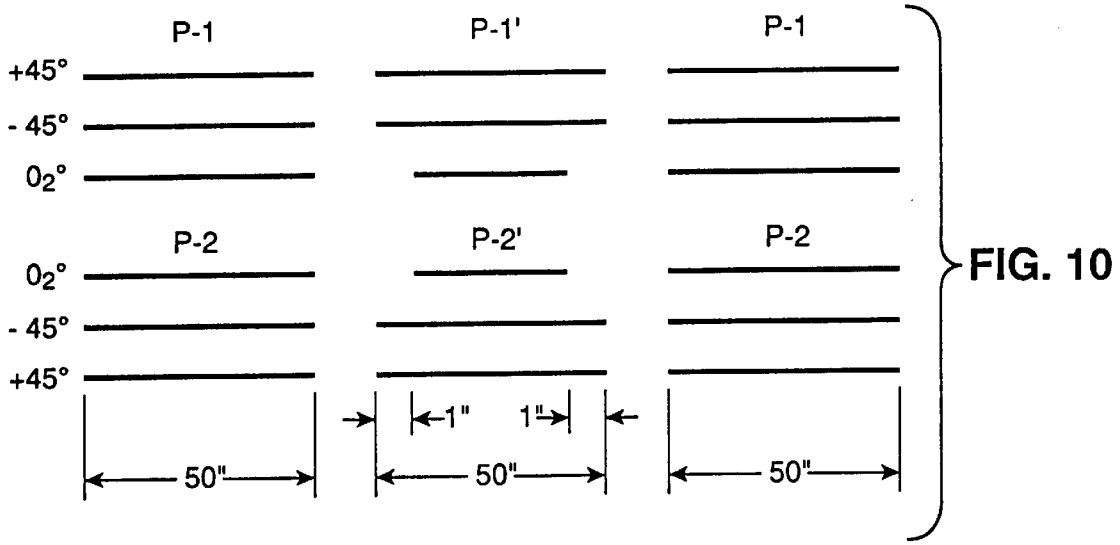
Figure 11:
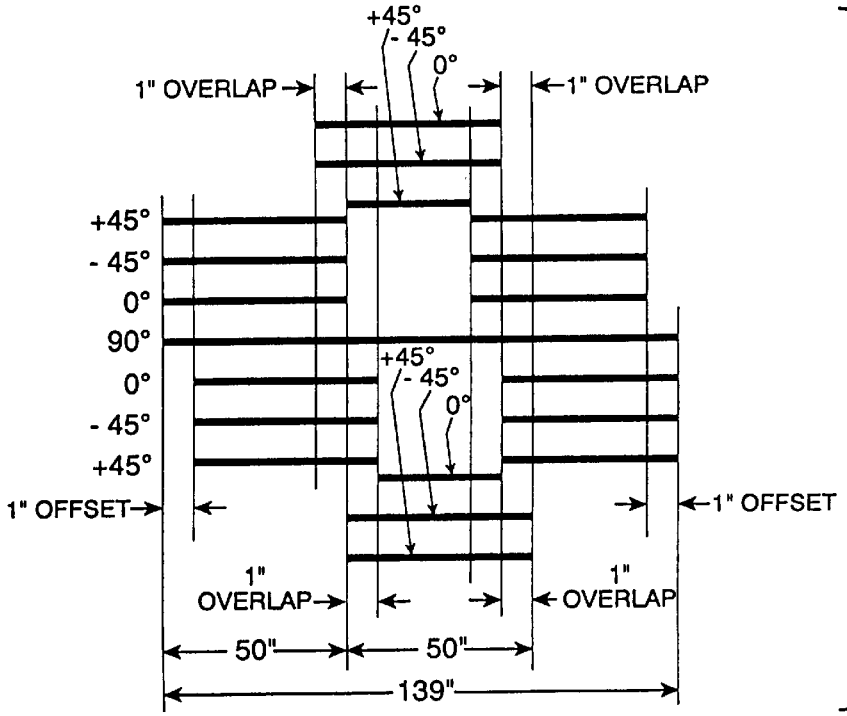
Figure 12A:
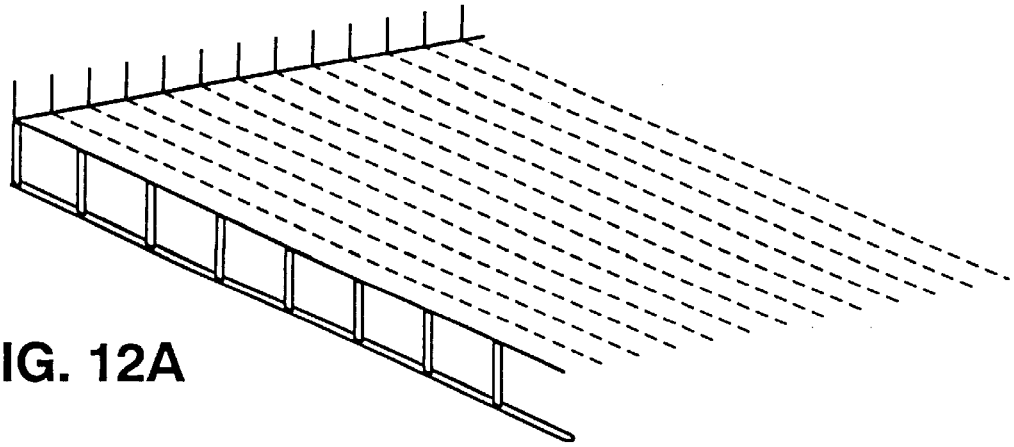
Figure 12B:
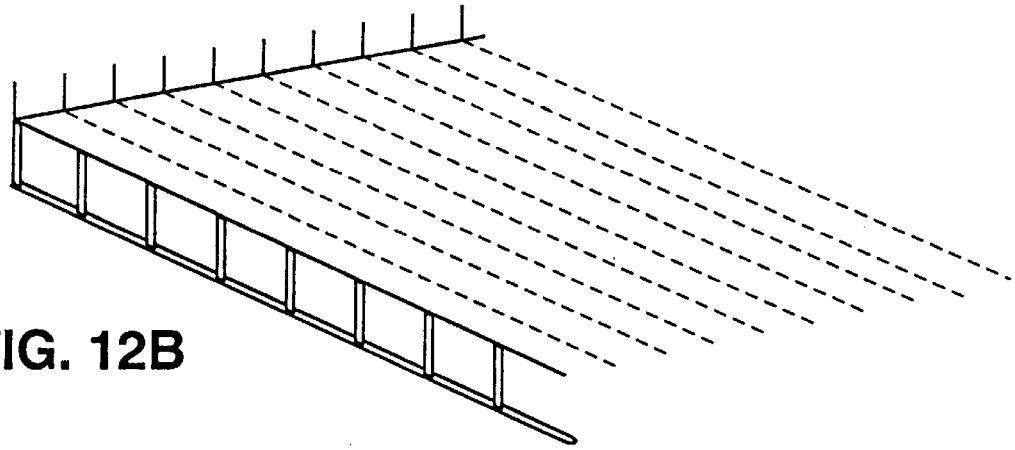
Figure 12C:
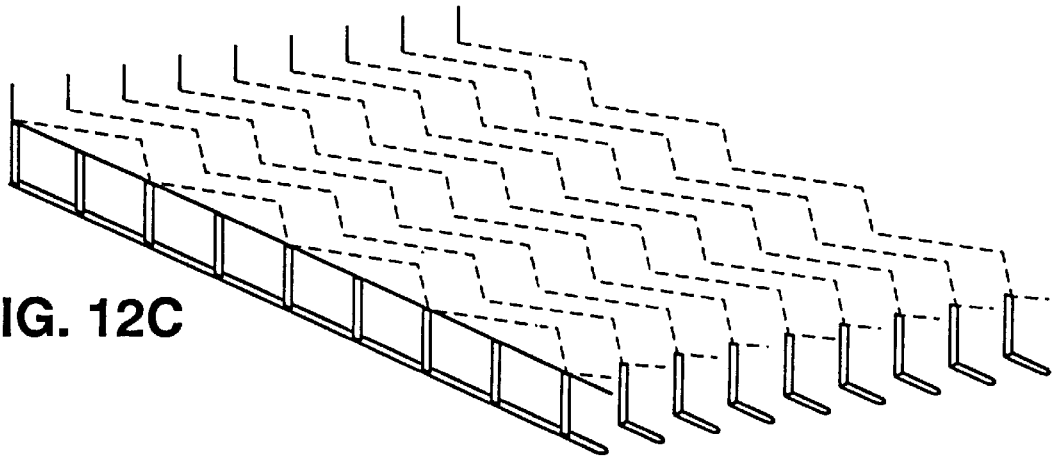

Having thus described the invention in general terms, reference will now be made to the accompanying drawings in which:

FIG. 1 is a fragmentary perspective view of a conventional prior art warp/knitting machine for producing a warp/knitted structural fabric;

FIG. 2 is a somewhat schematic plan view showing the arrangement of plies provided by a warp/knit fabric machine for producing one form of a structural fabric sheet in accordance with the present invention;

FIG. 3 is a series of three schematic views comprised of:

FIG. 3A which show a plurality of steps in one embodiment of the process of the present invention for producing a structural fabric sheet in which a pair of 0° plies are located at the outer surfaces of a stack of plies forming the sheets;

FIG. 3B which shows the production of a structural fabric sheet in which 0° plies are located in the middle of the stack of plies and +45° plies at the outer surfaces of the sheets;

FIG. 3C shows the production of a structural fabric sheet in which 0° plies are located next to but under the outer +45° plies of the stack;

FIG. 4 is a fragmentary perspective view showing one form of apparatus in accordance with the present invention for producing, for example, an eleven ply warp/knit fabric with 0° ply location freedom;

FIG. 5 is a somewhat schematic view showing, for example, an eleven ply multi-axial fabric sheet having five intermediate 0° ply layers;

FIG. 6 is also a somewhat schematic prospective view showing a slightly modified form of machine for producing a warp/knit fabric in accordance with the present invention;

FIG. 7 is a schematic view showing the steps involved in producing a fourteen ply fabric sheet in accordance with the present invention;

FIG. 8 is a schematic view showing the steps involved in a modified method of producing a fourteen ply fabric sheet in accordance with the present invention;

FIG. 9 is a perspective view partially broken away and showing doublers provided for local raised edge reinforcement in a multi-ply variable step thickness structural fabric preform in accordance with the present invention;

FIG. 10 is a schematic view showing the relationship of plies for purposes of splicing together warp/knit fabric sheets;

FIG. 11 is a schematic view showing the arrangement of the plies of FIG. 10 in a spliced warp/knit fabric sheet; and FIG. 12 comprises a series of (three) views showing several methods used to produce a structural sheet with a varied amount of drapability that include:

FIG. 12A which shows a minimum drape in a sheet;

FIG. 12B which shows a somewhat greater but still slight drape in a fabric sheet; and FIG. 12C which shows a much greater drape in a fabric sheet.

DETAILED DESCRIPTION OF PREFERRED EMBODIMENTS

Referring now in more detail and by reference characters to the drawings, a prior art warp/knitting machine P will now be described for purposes of understanding the prior art and its relationship to the present invention.

A. Prior Art Warp/Knitting Fabric Machine

The prior art warp/knitting fabric machine P included an endless belt 20 trained about rollers 22, and one of which was driven for moving the belt in a continuous and endless path. Upstanding pins 23 at the two side edges of the continuous belt 20 were provided for wrapping the structural fibers about these pins at the edges of the belt 20 and to hold structural fibers at a desired angle.

The upper surface of the belt was designed to receives tows of fiber from a first reciprocatively movable fiber feed member at a first station 24 for applying +45° parallel fibers, as a first ply, to the endless belt 20. A second station 26 was arranged to supply fibers, as a second ply, in a 90° parallel orientation by means of a reciprocatively shiftable feed member. Finally, a third station 28 was provided with a reciprocative feed member designed to apply parallel fibers at a −45° angle on top of the 90° angle fibers in order to form a third ply. Thus, a first ply of +45°, a second ply of 90° and a third ply of −45° was then provided.

In each of the aforesaid stations 24, 26 and 28, spools of fiber 30 were provided for feeding strands of the fiber to the reciprocative members which then applies the individual strands to the belt.

A warp beam 32 was also provided as part of the apparatus P for providing 0° tow fibers 34, as best shown in FIG. 1. In this case, the tow fibers were applied to the upper surface of the −45° fibers as shown in FIG. 1. Thereafter, a knitting station 36 was provided for knitting the four plies together in the form of a fabric sheet which was then rolled up about a take-up roller 38. As indicated previously, another prior art apparatus for producing warp/knit fabric is disclosed in the Hutson U.S. Pat. No. 4,550,045. In like manner, as also indicated previously, a method for producing chain stitched fabrics was shown in Germany Patent No. 8194 dated Feb. 3, 1949 by Heinrich Mauersberger.

As further indicated previously, the prior art apparatus was limited to essentially four plies. In a few cases, sheets of a greater number, of up to eight plies, were produced with this type of warp/knit machine, but in all cases had only one upper surface of 0° fibers. However, the machine had to be modified in order to produce a sheet of more than four plies. No one has previously effectively made a warp/knit structural fabric sheet with more than eight plies and no one has made an effective structural fabric sheet in which there was complete 0° ply freedom location. Furthermore, no one has incorporated high strength sewing or knitting threads to achieve damage tolerance in the end product.

B. Fabric Sheets Of The Invention With 0° Ply Location Freedom and Unlimited Number of Plies.

FIG. 2 is somewhat of a schematic illustration showing the arrangement of plies in a sheet which can be produced in accordance with the present invention. In this case, a sheet schematically designated as 40 is provided with a plurality of 90° fibers constituting a first ply 42, and which received a ply of +45° fibers 44 and followed by a third ply of −45° fibers 46, as shown. In addition, a fourth ply 48 of 0° fibers is also shown. However, it should be understood that these 0° fibers can be located anywhere in the arrangement of the plies, as hereinafter described. The 0° ply can also be supplied using a large number of individual spools of fiber tow in place of a warp beam. This type of fiber pattern arrangement was not readily possible in accordance with the prior art warp/knit machines.

In the prior art apparatus, the edge of the continuous belt 20 was provided with the pins 23. Thus, as the tows moved back and forth across the belt during continuous belt movement in order to make a ply, the fibers of the tow wrapped around the pins on each side of the belt and the tension on the fibers wrapping about the pins 23 at the longitudinal edges of the belt 20 held the fibers in an aligned position. The knit threads applied at the knitting station 36 typically had a spacing of five rows per inch of width and a stitch step usually from about ⅛ inch to about ¼ inch. These knit threads formed chain-stitches or so-called "back and forth zig-zag stitches", known as "tricot" stitches. Thus a straight line chain-stitch or tricot zig-zag stitch or a combination of both of them could be used to combine the several layers in a knitting or sewing operation.

The sheet produced in accordance with this prior art apparatus using, for example, polyester 70d thread had a minimum effect on mechanical properties of the laminated fabric sheet and essentially had little or no damage tolerance properties and had similar properties to laminates made from unidirectional unstitched or unknit materials with the same thickness and fiber pattern.

In accordance with the present invention, it is now possible to make for example an eight ply fabric, a sixteen ply fabric, or a twenty four ply fabric sheet, etc. or sheets of intermediate number of plies. There is essentially no known upper limit to the number of plies which can be applied to a structural fabric sheet. In most cases, a desired fiber pattern, at least for four of the plies, is 0°, +45°, 90° and −45° although +30° to +60° plies in place of the 45° is sometimes preferred. Also, 0°, +60°, −60°, 0° is an example of a preferred fiber orientation pattern for certain structural application. In accordance with the present invention, the fiber plies are often arranged with respect to one another at acute angles in multiples of 15°. However, even here the plies are not limited to this precise arrangement and they could be applied at other acute angles with respect to one another. A few variations of the processes used for producing sheets with one or more 0° plies in locations other than on only the upper surface, are hereafter described.

Referring now to FIG. 3, there is schematically illustrated three different warp/knit arrangements to produce multi-ply/multi-axial structural sheets and include FIGS. 3A, FIG. 3B and FIG. 3C. In FIG. 3A, there is shown an arrangement in which there is a first group of four plies comprising 0°, +45°, 90° and −45°. A second group of four plies comprises 0°, −45°, 90° and +45°. The second stack is inverted so that the 0° ply becomes a lower ply. It should be recognized that when inverted the −45° ply becomes a +45° ply and the +45° ply becomes a −45° ply. These two stacks of four plies as show in FIG. 3A are then stitched together, as shown in Step 3 of FIG. 3A to form a sheet having a ply arrangement of 0°, +45°, 90°, −45°, −45°, 90°, +45° and 0°. In each case, it can be seen that the plies are facewise disposed upon each other in each of the individual stacks. Further, they are knitted together with a tricot knit polyester 70d thread or similar thread and with a 2.5 to about a 12 gauge pattern. This can be varied depending on the desired handling characteristics (drapability) and mechanical properties of the fabric.

FIG. 3B shows an arrangements in which there are the same two stacks of fiber plies and with the first stack being formed in a Step 1 having a 0°, +45°, 90° and a −45° plies. In Step 2 a four ply stack is formed with a fiber ply arrangement of 0°, −45°, 90° and +45°. The first stack produced in accordance with Step 1 is then turned over and the two stacks of Step 1 and Step 2 are then sewn together in order to form the product shown as +45°, 90°, −45°, 0°, 0°, −45°, 90° and +45°; in Step 3B.

FIG. 3C also illustrates a further embodiment of producing an eight ply sheet in which the −0° plies are located just under and just over the two +45° surface plies, such as +45°, 0°, −45°, 90°, 90°, −45°, 0°, +45° shown in FIG. 3C, Step 3.

In accordance with the above, it can be seen that the 0° plies can be essentially located in any desired location in the stack of plies. The few exemplary illustrations of an eight ply sheet construction in FIG. 3 show various arrangements in which the 0° plies can be located and secured using a 2.5–to a 12 gauge tricot knit on the outer surface. Moreover, the 0° plies are located immediately under the outer surfaces of the sheet as shown in the arrangement of FIG. 3. This group of figures also shows that the 0° plies could be located at the center of the sheet or otherwise at other locations in the sheet. In all cases, the various plies produced in the third step (Step 3 of FIG. 3) are also stitched together with a polyester or similar thread, as for example, a 70d light weight thread or the like as employed in FIG. 3A. A 12 gauge to a 2.5 gauge chain-knit or tricot knit is used to secure the two stacks of fabric sheets into a single unitary sheet and which is shown in the three steps in FIG. 3A, 3B and 3C. Increasing the knit gauge from 2.5/inches to a gauge of 5 or greater produces a more stable fabric and a stiffer handling dry fabric. It also reduces the drape of the fabric to be used in the manufacture of double contour parts.

It has been found in accordance with the present invention that it is possible to produce multi-ply fabric sheets including a large number of plies e.g., nine or more plies, due to the fact that the various plies can be at least temporarily secured to one another during the actual warp/knit process. Thus, in one approach, the various plies of fabric are contacted at selected locations with a slight amount of a curable resin. The amount of resin employed is quite small, usually 2% to 6% by weight of fiber, and is only sufficient to merely hold the individual fibers and plies in a parallel array. The quantity of resin in an epoxy composite finish is often sufficient for this task. It is important in the sheets of the present invention to assure a uniformity and parallelity of each of the fibers in an individual ply. Moreover, it is important to ensure that all of the plies are held in proper registration with respect to one another. This can be readily accomplished by using the small amount of resin contacted onto the individual plies and onto the individual fibers in a particular ply. If desired, the resin may be advanced to a B-stage but is not hardened at this point in time. The fabric may be placed through heater rolls to soften the resin and then through chill rolls to compact and set the resin to thereby hold the fibers in the desired arrangement.

Another approach used in connection with the holding of the 0° plies in a proper registration and the holding of the fibers in a particular ply in parallel arrangement is to use the knitting stitching approach, as for example, chain stitching or tricot stitching, as aforesaid. In either case, the fibers are held in parallel arrangement in a ply and the various plies are properly aligned relative to one another.

In the chain stitching, loops are formed under each of the fibers and in somewhat of a zig-zag arrangement. The stitches are locked together on their underside along with a bobbin thread that cause the individual vertical threads to be locked into place. In the tricot stitching arrangement, rows of side-by-side needles are used to form loops with a zig-zag arrangement with respect to the fibers. In this way, the various plies and particularly the 0° plies are pre-stabilized. Thus, before the 0° plies are even applied to the other plies, they are typically pre-stabilized by the knitting or the small amount of resin, as aforesaid.

In accordance with the present invention, it is also possible to produce a sixteen ply fabric by repeating Step 1 of the previous process in order to accomplish two stacks or four plies from Step 1. Step 2 would also be repeated in order to form two stacks of Step 2. Thereafter, the four stacks would be combined together in order to provide a sixteen ply warp knit fabric. Again, the various stacks could also be reoriented in any desired arrangement before securing together in the same manner as described in connection with an eight ply sheet. The same process can be used for producing a twenty four ply fabric sheet or a thirty two ply fabric sheet, etc. always holding the balanced plies in a desired overall pattern.

Some of the fibers which may be used in the formation of the sheets of the invention are those formed of "glass, Kevlar, graphite (carbon), polyester and Nylon". The threads which are used in the stitching are preferably natural threads or otherwise synthetic threads. Among the preferred threads are glass, Kevlar, graphite (carbon), polyester and Nylon and which are selected in accordance with the desired properties.

C. Warp/Knit Fabric Machine of the Present Invention

FIG. 4 illustrates one form of warp/knit machine in accordance with the present invention for producing a structural multi-axial, multi-ply fabric sheet in one continuous operation and which can include one or more 0° plies located in positions other than the upper surface or for that matter, only on the upper surface, as may be desired. In the embodiment of the invention as shown in FIG. 4, there is provided a continuous belt 52 which also has upstanding retaining pins 53 along the longitudinal edges of the belt.

The apparatus of the invention further comprises a first station 54 for applying a ply of +45° fibers. A second station 56 provides a second ply of 0° stabilizes fibers. A third station 58 provides 90° fibers. Again, the stations 54 and 58, as well as other subsequently described fiber application stations, except for the 0° ply stations, will each include a carriage which shifts back and forth across the belt as the belt is rotating and thereby applies the fibers in the desired angulated path. The carriages at each of these stations will similarly contain sources of fiber tow or threads for application to the continuous belt. Moreover, the carriages will move in the desired angulated relationship. Thus, for example, the carriage at the first station may move in approximately a +45° path with respect to the path of movement of the belt. The carriage at the third station which applies 90° fibers will move back and forth across the belt. The carriage at a fifth station, as hereinafter described, will move back and forth across the belt at a −45° angle with respect to the path of movement of the belt. Finally, it should be noted that the +45°, 90° and −45° carriages are not exactly at these angles as they apply fibers to pins on each side of a traveling belt. The exact angles of these carriages are adjusted to the speed of the belt so that the resulting parallel layers of fibers are at the required angle.

A fourth station 60 also provides an additional ply of stabilized 0° fibers over the 90° ply. A fifth station 62 a ply of −45° fibers followed by a sixth station 64, which is another 0° stabilized ply station, and which applies a sixth ply of 0° stabilized fibers. This is also followed by a seventh station 66 applying −45° fiber plies and an eight 0° stabilized station 68 applying an eighth ply of 0° stabilized fibers. A ninth station 70 applies a 9th ply of 90° fibers and a tenth station 72 applies a 10th ply of 0° stabilized fibers. Finally, in the embodiment as shown in FIG. 4, there is an eleventh station 74 which also provides an 11th ply of +45° fibers.

Thus, in accordance with the apparatus of FIG. 4, the stations apply plies to obtain a sheet schematically shown in FIG. 5, such that:

the 1st station applies a +45° ply;
the 2nd station applies a 0° ply;
the 3rd station applies a 90° ply;
the 4th station applies a 0° ply;
the 5th station applies a −45° ply;
the 6th station applies a 0° ply;
the 7th station applies a −45° ply;
the 8th station applies a 0° ply;
the 9th station applies a 90° ply;
the 10th station applies a 0° ply; and
the 11th station applies a +45° ply.

Each of the various eleven plies which will form the fabric sheet of FIG. 5 are then knitted together at a station 76 comprised of a plurality of aligned and vertically penetrating knitting or sewing needles and which tie the fiber plies together by knitting or stitches to stabilize and form the sheet. The sheet is then wound on a take-up roller 78, all as best shown in FIG. 4.

It should be understood that the embodiment as shown in FIG. 4 is only illustrative of numerous embodiments which could be provided. For example, only two or three, or for that matter, more 0° stations could be provided. In addition, the other stations could provide additional or other angular fiber arrangements. Nevertheless, this embodiment of the apparatus shows that it is possible to now provide a large number of plies on a warp/knit machine and with 0° plies located anywhere throughout the sheet as may be desired.

Due to the fact that there are a large number of individual spools of fiber used to produce the single 0° plies of material, it is often times more practical to use a 0° beam of parallel rows of 0° fibers or 0° tow which is prepared prior to the actual start of the warp/knit operation. Thus, in the embodiment as shown in FIG. 4, the five beams used at the stations 56, 60, 64, 68 and 72 all must be prepared so that the fibers are stabilized. This will ensure that all of the fibers remain in their desired 0° orientation in parallel arrangement with one another without forming gaps or overlaps as they pass along the traveling belt to the knitting station.

FIG. 6 shows an apparatus used for stabilizing the 0° fabric which is to be used in a multi-ply sheet produced in accordance with the present invention. In this case, the fiber is unwound from individual spools 80 which constitute a spool storage and displacement station. Moreover, at this station, tension control may be maintained on the individual fibers 82 as they are unwound from the spools 80. In addition, a roll arrangement 84 is provided to maintain individual tow tension control. The various fibers under tension are then passed through alignment pins 86. It can be seen in FIG. 6 that alignment pins are located on both the upper and lower surfaces of the individual tows.

Three tow-spread rolls 88 are also provided to ensure that the tows are evenly and individually spread in parallel arrangement. Thereafter, the tows may be knitted together with a tricot stitch at a knitting station 90 having a plurality of knitting needles, as shown, and which thereby produces a stabilized 0° ply of fabric 92. The fabric ply may be then rolled on a beam 94 to form a layer of 0° stabilized tow.

It is also possible to use 0° layers of carbon or other fiber tow directly from creels. Moreover, it is possible to mix the fibers forming part of the various plies so that one ply may contain e.g. glass fibers of 0° orientation of one inch width and the remainder of the ply may contain e.g. carbon fibers of the same 0° orientation. In this exchange, the various plies may contain alternate bands of differing widths, as for example, a band of glass fibers of 0° orientation with e.g. a one inch width and alternate two inch width bands of carbon fibers and of a 0° orientation. It is also possible to use alternate fiber tows of, for example, fiberglass and carbon, or any other mix, to make the ply for the fabric.

As indicated previously, it is possible to mix the various fibers in the individual plies. Thus, one ply may contain for example fiberglass and another ply may contain carbon fibers. Moreover, additional plies may contain still further fibers such as for example Kevlar fibers. Thus, a hybrid mix of fibers may be in a ply, or alternate ply layers of fiber may be in the fabric.

Each of the fibers in the 0° layers may be fixed by including a small number of 90° thermoplastic coated fine fiberglass threads across the fabric. A thermosetting coating could be, for example, an epoxy "sticky" coating and the thread could again be a fine fiberglass thread. The thread is preferably applied in a line transversely across the 0° fibers or otherwise in a continuous process along with the warp/knit processing using a technique of back and forth application. Thereafter, the thread would be impressed into the 0° fiber tows by compaction rollers for stabilization of the 0° fibers.

One stabilized process for achieving a 0° fiber ply in a desired location would be to warp/knit at least two or more individual subassemblies and then warp/knit the subassemblies together. The concept of producing individual stacks and then warp knitting the stacks together has been partially shown in FIG. 3. However, it is also possible to warp knit a large number of stacks together in order to form a wide warp knit fabric.

FIG. 7 shows one approach for a production of a thick warp/knit fabric. As an example, and in a first step, a stack containing a ply of 0°, +45° and −45° plies is produced. A second stack of 0°, −45° and +45° plies is produced in a second step. The stack produced in the second step is turned over and the stacks produced in steps 1 and 2 are thereupon knitted together with the addition of a 90° ply in a third step in order to form a seven ply stack with 0° plies on the outer layers. Thereafter, or otherwise, simultaneously, in a fourth step, a stack of 0°, +45° and −45° plies is produced. In addition, and in a fifth step, a stack of 0°, −45° and +45° plies is produced. This stack in accordance with step 5 is also turned over and the stacks of step 4 and step 5 are then knitted together, also with the addition of a 90° ply to make a seven ply product in a step 6.

As a final step in the production of the thick fabric containing fourteen plies, the two fabrics of steps 3 and 6 are then knitted together in order to form the thick fabric as shown in step 7.

FIG. 8 shows the production of another modified form of producing a thick fabric. In this case, in step 1, a four ply fabric is shown produced in a warp/knit process. In step 2, a three ply warp knit fabric is produced and then turned over. In third and fourth steps, a four ply stack and a three ply stack are respectively produced. The stacks of steps 2 and 4 are thereupon turned over and the four stacks are warp knitted together in order to produce a fourteen ply fabric. It can be seen in connection with the production of these fabrics, whether they are regular fabrics or thick fabrics, that there is a freedom of location of 0° plies. These 0° plies can be essentially located anywhere in the stack as desired.

In connection with the freedom of location of the 0° plies, it is possible to form a first ply in accordance with Step 1 and a second ply in accordance with Step 2 as shown in FIG. 8. Thereafter, the sub-sheet of Step 1 would then be turned over so that the 0° ply is adjacent to the 0° ply of the sub-sheet formed in Step 2. In this way, a sheet having a ply arrangement of: +45°, 90°, −45°, 0°, 0°, −45°, 90°, +45° would be formed. Further, other combinations could also be formed. In addition, it is not necessary to use four plies and three, four, five or more plies could also be used in order to locate the 0° plies in any desired position in the sheet.

It is to be noted in accordance with the present invention that when a sheet is to be prepared with a large number of plies, all such plies are not sewn directly together. Rather, individual stacks of plies are formed. Thus, two or three or more of stacks may be formed and which are subsequently stitched together. Furthermore, not all of the stacks are marginally registered and stitched together in one operation. As an example, two or more stacks may be stitched together and in a second operation two or more additional stacks may be stitched together and in a third operation two or more additional stacks may again be stitched together, etc. These individual stacks may then be stitched to one another in order to form the multi-layer fabric. This approach to making a sheet with a large number of plies has been found to be quite efficient and capable of being accomplished on commercially available warp knit machines.

D. Variation in Fiber Thicknesses and/or Weight

It is also possible to vary the thickness and for that matter, the weight, of each ply in order to control the fiber orientation percent and the resultant laminate structural properties. The few following examples are illustrative to show the various possibilities of controlling thickness and weight in a ply or among a plurality of plies.

If it were desired to obtain a (0°, +45°, 90°, −45°)n pattern with 25% 0°, 50% +/−45°, and 25% 90°, then fiber tows would be used in the following amounts:

| | | |
|---|---|---|
| 0° | = | 145 g/m |
| +45° | = | 145 g/m |
| 90° | = | 145 g/m |
| −45° | = | 145 g/m |
| | | 580 g/m$^2$ |

145 grams per square meter is a typical weight for a layer of 3K (3,000 filament tow) carbon fibers. However, it is possible to make a fabric with less weight per ply, although the resultant material will have lower mechanical properties or be far more expensive if made from a carbon fiber tow. It is also possible to spread lesser weight tows on the plies. It is further possible to provide plies with greater weight than the 145 grams per square meter per ply. For example, each ply of material could be 200 gm/m$^2$ with the 4 plies of material weighing 800 gm/m$^2$. This pattern would cure to a thicker panel but would still have the same mechanical properties of the fibers in a 0°, +/−45° and 90° orientation.

If it were desired to obtain a (0°, +45°, 90°, −45°) pattern with the same overall weight but with a fiber pattern of 50% 0°, 25% +/−45° and 25% 90°, then fiber tows would be used in the following amounts:

| | | |
|---|---|---|
| 0° | = | 290 g/m$^2$ |
| +45° | = | 73 g/m |
| 90° | = | 145 g/m |
| −45° | = | 73 g/m |
| | | 580 g/m$^2$ |

If it were desired to obtain a (0°, +45°, 90°, −45°) pattern with the same overall weight but with a fiber weight percent pattern of a 40% 0° ply, 40% +/−45° ply and 20% 90° ply, then fiber tows would be used in the following amounts:

| | | |
|---|---|---|
| 0° | = | 232 g/m |
| +45° | = | 115 g/m |
| 90° | = | 116 g/m |
| −45° | = | 116 g/m |
| | | 580 g/m$^2$ |

In the three above-identified examples of varying the fiber ply weight, the percent of change of fiber orientation will alter the mechanical properties of the laminate substantially.

Nevertheless, by varying the individual fiber areal weight of a ply, it is possible to maintain the same total fabric weight with the same number of plies and maintain a constant laminate thickness. Additional control over the fiber pattern and the resultant mechanical properties can also be obtained by increasing the number of plies in a stack forming a structural sheet or by varying the overall weight of the fibers in a stack.

E. Damage Tolerance

It is also possible to account for damage tolerance and to reinforce a warp/knit fabric by substituting different types of penetrating knit thread. For example, a Kevlar 29 thread of 1600 d or other similar strength thread could be used in place of a 70d polyester thread in the final knit assembly.

The following four examples show how a damage tolerance can be built into a warp/knit fabric sheet which is impregnated with resin and cured. Each of these two examples are set forth with respect to a flat panel sheet.

| | |
|---|---|
| Unstitched - $(0°, +45°, 90°, -45°)_{3S}$ (Approximately 0.32") | |
| Compression - Un-notched | 75,000 psi |
| Compression After 70 Ft. lbs. Impact-1/2" diameter steel ball | 23,000 psi |
| Peel - $G_{1C}$ | <1 in. lb./in. |
| Stitched - 1600 d Kevlar - 40 penetration/in.$^2$ $(0°, +45°, 90°, -45°)_{3S}$ (Approximately 0.32) | |
| Compression - un-notched | 65,000 psi |
| Compression After 70 Ft. lbs. Impact-1/2" diameter steel ball | 40,000 psi |
| Peel - $G_{1C}$ | Flexural Failure at >36 in. lbs./in. |
| Stitched - 1600 d Kevlar - 40 penetration/in.$^2$ $(0°, +45°, 90°, -45°)_S$ (Approximately 0.11") | |
| Compression - Un-notched | 80,000 psi |
| Compression Open Hole | 52,000 psi |
| Compression After Impact-1/2" diameter steel ball (26 Ft. lbs.) | 42,000 psi |
| Stitched - (400 d Kevlar - 40 penetration/in.$^2$ $(0°, +45°, 90°, -45°)_S$ (Approximately 0.10") | |
| Compression - Un-notched | 90,000 psi |
| Compression Open Hole | 58,000 psi |
| Compression After Impact-1/2" diameter steel ball (26 Ft. lbs.) | 40,000 psi |

Mode of Failure

No Stitching-De-lamination

Stitched-No De-lamination

When considering the above four examples of stitched and unstitched flat panels, the unstitched flat panel will fail by de-lamination under compression or compression after impact loading. The stitched panel will fail by compression shear with no de-lamination. The unstitched panel has the highest strength undamaged, but has the lowest damage tolerance. The thick panel with the 1600 d Kevlar stitch thread had the lowest undamaged strength and among the best damage tolerance properties. The thin panel with Kevlar 29 1600 s stitch thread had lower undamaged strength and surprising maximum damage tolerant properties. The thin panel with Kevlar 29 stitch threat had high undamaged strength properties along with good damage tolerance properties. Thus the choice of a stitch thread affects mechanical properties.

It is also possible to provide localized reinforcement in a warp/knit fabric by producing a sheet which can vary in the number of plies over the length or width of the sheet. For example, FIG. 9 is a partial fragmentary perspective view of a sheet having a local reinforcement by a different number of plies over the area of the sheet. Thus, in FIG. 9 there is a sheet 100 comprised of an overall four ply stack or segment 102. A portion of the sheet is provided with another stack to make a five ply stack or segment 104 and another portion of the sheet is provided with two additional stacks to make a six ply stack or segment 106.

In addition utilizing a skin which can vary in the number of stacks, as for example, a four ply stack to a five ply stack to a six ply stack as shown in FIG. 9, it is possible to add doublers to these stacks. For example, a first doubler 108 formed of a two ply stack is added to and surrounds the periphery of the four ply stack as shown in FIG. 9. A second continuous doubler 110 is added to the five ply stack in the sheet 100 and surrounds the peripheral edge portion of this five ply stack, thereby forming a total of seven stacks on the edge periphery of the stack or segment 104. A third two stack doubler 112 is added to the periphery of the third stack containing six plies and thereby forms an eight stack outer periphery on the six ply stack 106.

In the aforesaid example of adding local reinforcement and doublers, the four ply sheet segment 102 may have a thickness of 0.216 inches, the five ply sheet segment 104 may have a thickness of 0.270 inches and the six sheet segment 106 may have a thickness of 0.324 inches. With the doublers added, the first sheet segment 102 with the doubler added would have a thickness of 0.324 inches and the second sheet segment 104 with the doubler 110 added would have a thickness of 0.378 inches and the third sheet segment 106 with the added doubler 112 would have a thickness of 0.421 inches. In the previously described sheet 100, it can be seen that this stack is a balanced seven ply warp/knit fabric sheet with a fiber pattern of repeat +45°, −45°, 0°, 90°, 0°, −45° and +45° stacks. The material is warp/knit with 70d polyester thread to form four individual multi-ply stacks. A leader and a tail are attached to the stacks in order to lead these stacks properly into the warp/knit machine. One sheet segment 104 and the second sheet segment 106 will be cut and placed over the full length four ply sheet segment 102. Thereafter, a two stack picture frame type doubler is cut and laid over and placed on the sub-sheets 102, 104 and 106. The doubler may be held in place by using a portable tuft gun or hand stapler or a heat set with pressure to lightly secure the stacks in their aligned positions, eventually with a slight amount of curable resin.

This assembly, as shown in FIG. 9, is then introduced into the warp/knit machine initially starting with the leader attached to the four ply sheet section 102. For this purpose, a Kevlar 29 knit thread of 1600 d may be used in place of the polyester knit fibers to increase damage tolerance. This assembly of plies is then passed through the warp/knit machine with, for example, a five gauge stitch thread (five rows per inch) with a ⅛ inch stitch or knit step to secure all of the sheets segments and the doublers together. This thereby forms a stable warp/knit pre-form which is then ready for stitching additional stiffness or is otherwise ready for final resin matrix impregnation or so-called "resin film infusion" (RFI) or "resin transfer molding (RTM) processing.

F. Wide Spliced Fabric Sheet

The present invention also provides a unique spliced wide fabric sheet and method for producing a spliced wide fabric sheet. In the prior art, attempts to splice two fabric sheets together in order to increase the overall width thereof typically and almost always resulted in weakness along the spliced joints or excess thickness and weight caused by the overlap area of the joint. As a result, there was always a reluctance to splice two or more sheets together because of the inherent loss of strength along the splice joints. In addition, there would always be an extra thickness of fabric at an overlap spliced joint that has a major effect on the tooling design and cost.

In accordance with the present invention, it is possible to splice two or more sheets together without any substantial loss of mechanical properties at the splice joint. In order to accomplish the splicing, two warp/knit fabric machines may be used. In the example attendant to FIGS. 10 and 11 of the drawings, a 50 inch warp/knit machine and a 141 inch warp/knit machine were used in order to produce a 139 inch useful width fabric sheet with seven plies. Moreover, the plies used in the fabric sheet had a fiber pattern of +45°, −45°, 0°, 90°, 0°, −45°, +45°. Furthermore, in the example attendant to FIGS. 10 and 11, the sheet had two splices in each of the +45° and −45° plies and no splices in the 0° or 90° plies.

Referring again to FIG. 10, it can be seen that there is a first sheet sub-panel P-1 comprised of three warp/knitted plies having a fiber pattern of +45°, −45° and 0°. Each of these plies are 50 inches wide using a five gauge tricot knit pattern and a 70d polyester thread. However, it is also possible to use a knit of 2.5 to 12 gauge in order to produce this first sub-panel P-1. As a second step, three additional plies were used to make a 50 inch wide sub-panel P-2 in FIG. 10 and this 50 inch wide sub-panel P-2 had a fiber pattern of −45°, +45° and 0°. Moreover, the same gauge of knitting was used as in the first sub-panel P-1 and the same polyester thread was also employed.

In addition, a second set of plies were added together in order to form a like sub-panel P-1 so that there were two sub-panels P-1. Further, a second sub-panel P-2 is also formed such that there are a pair of sub-panels P-2 as shown in FIG. 10. It can be seen that each of the sub-panels P-1 and P-2 have an overall width of 50 inches.

As a third step in the production of the spliced sheet, a third sub-panel P-1' and another third sub-panel P-2' are also formed. Again, a similar pattern for the sub-panel P-1' of +45°, −45° and 0° is employed. Initially, this sub-panel P-1, has a width of 50 inches with 45° plies and with only a 48 inch wide 0° ply, leaving a one inch band on each of the opposite edges of this sub-sheet which is the area used to make an overlap in the joint.

As a fourth step, the sub-panel P-2' is formed much in the same manner as a sub-panel P-1 with a fiber pattern of −45°, +45° and 0°. Here again, the sub-panel P-2', is 50 inches wide with 45° plies and a 48 inch 0° leaving a one inch band of 45° plies on each edge of the fabric which again constitutes the area of overlap in a splice joint.

It can be seen that in the first and second steps of producing the sub-panels P-1 and P-2, the panels thus produced are all 50 inches wide in all three plies. However, in Steps 3 and 4 one third of the fabric is warp/knit with 0° plies only 48 inches wide thereby leaving a one inch wide band of 45° fibers along each edge of the fabric.

As a fifth step in the production of the spliced fabric segments, two lengths of sub-panels P-1, as shown in FIG. 10, are combined with one length of the sub-panel P-1' as now shown in FIG. 10. Two lengths of the sub-panel P-2 are combined with one length of the sub-panel P-2' with only one ply (a 90° ply) centered between the sub-panels P-1 and P-2. These two panel segments along with a full width 90° center ply between the two segments are then knitted together using, for example, a 2.5 to a 12 gauge 70d polyester thread or similar thread. It is also important in this example to note that one of the 50 inch wide fabric panels is required to be slit to 42 inches of width so that the final product will fit into an existing warp/knit machine. (A 150 inch wide warp/knit machine if available would not require this extra step.)

In the splice zone, +45° and −45° plies overlap one another by one inch and there are no more than two overlapping plies in any area of the seven ply product sheet which is being produced. The P-1 and the P-2 sub-panels are fed into the warp/knit machine such that the splice zones created are offset by one inch. In this way, there are no more than two plies overlapping in any area of the seven ply sheet which is being produced. Thereafter, the completed warp/knit fabric may be trimmed to a width of 139 inches as shown in FIG. 10.

G. Hybrid Warp/Fail Fabric

It is also possible to make various hybrid fiber preforms, as for example, using differing fiber mixtures, as may be desired. For example, regular 33 million psi modulus carbon fibers at +45° and −45° and 90° orientations and high 42 million psi or higher modulus carbon fibers at 0° may be warp/knit to produce a fabric with higher stiffness in the 0° than in the +/−45° or 90° orientation. Fiberglass combinations can also be employed to control stiffness in one direction or to lower overall cost. It is also possible to make a sheet which is relatively soft and bendable with one material in a first direction and with a rigid material in an alternate direction. Thus, a sheet could be bendable in a 0° direction and rigid in a 90° direction. This can be accomplished by laying nylon or fiberglass tow in the 0° first or soft direction and carbon fibers in the 90° direction. Again, any variation thereof can also be achieved. A product using carbon fibers in all +45° and −45° orientations can be made to obtain increased torque or twist resistance strength and fiberglass in the 0° and 90° directions for lower modulus or for lower cost.

It is also possible to incorporate alternate widths of high strength fiber, such as carbon fibers e.g. 2 inches wide, and fiberglass tow e.g. ½ inch wide, to make a fabric sheet of lower cost but with strength almost equal to a sheet formed of all carbon fiber. This will also provide added damage tolerance strength under tensile loading from bands of fiberglass strips running lengthwise across the width of the panel.

H. Drapability

FIG. 12 schematically shows various ways in which to obtain a desired degree of drapability in a fabric sheet. A multi-axial warp/knit fabric can be manufactured by the processes as described herein and which is very stable. However, the sheets heretofore described are difficult to form into double contour shapes. There has been a need for a sheet material which can be doubled contoured in order to form a desired shape with good handling characteristics and yet also make high quality flat parts.

FIG. 12A shows a fabric warp/knit using a ten gauge straight chain knit thread that produces minimum drapability and maximum stability. It can be seen that needles 160 apply stitching to the fibers 162.

FIG. 12B shows a lighter gauge chain knit fabric produced with a 5 or a 2.5 gauge straight chain knit thread. In this case, because of the lighter tie thread count, drapability is improved. Further, less stitching is employed and this adds to the drapability of the fabric which is produced with the needles 160 and the stitching fibers 162.

FIG. 12C shows an all tricot knit fabric 164 with further increased drapability. In this case, the stitch gauge is reduced to 2.5 rows per inch and the stitch forward step is increased from one-eighth inch to one-fourth inch or even greater until the fabric becomes actually too fragile to handle. Fabric made with a one knit path through the warp knit machine and with minimum knit thread density produces materials with a maximum drapability.

The sheets of the present invention can be used to make warp/knit fabric which can be cut, stacked and stitched to make a dry fiber preforms with full freedom of fiber stacking alignment and individual ply fiber areal weight which can be used in structural aircraft and aerospace components, aqueous components and other environments where high strength and reduced weight are desired. Further, the invention allows the use of glass and other lower cost fibers in order to make multi-layered products for application in the sports industry, building trades, transportation industry, etc.

The present invention allows the formation of a complete dry fiber preform with built in damage tolerance directly from a warp/knit machine. Further, the invention has splicing methods to make a special wide fabric with no substantial loss of mechanical properties across the entire length of the splice. In addition, the invention allows for complete freedom of location of 0° fibers in a multi-ply sheet. Layers of different, but yet controllable, fiber plies may also be included in the same sheet. In addition, the fiber areal weight and thickness per ply can be varied as well as the overall fiber orientation. As indicated, damage tolerance properties can be added to the sheet and doublers and localized area build-ups can also be used direct at a warp/knit station.

Thus, there has been illustrated and described unique and novel multi-ply structural fabric sheets and unique methods and apparatus for producing the same and which achieve all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what we desire to claim and secure by Letters Patent is:

1. A warp/knitted multi-ply structural fabric sheet which is non-woven and non-crimped and capable of being used in structural applications, said fabric sheet being comprised of:

a) a plurality of plies other than 0° plies disposed upon one another, each ply being formed of parallel non-overlapping fibers laid side-by-side, and the fibers in one of said plies being oriented at an angle to the fibers in one of the other plies;

b) a 0° pre-stabilized ply located in said fabric sheet other than on an upper surface thereof, the 0° pre-stabilized ply being formed of parallel non-overlapping 0° fibers laid side-by-side and joined together by an additional joining material prior to the 0° pre-stabilized ply being placed in facewise engagement with another of the plies, so as to substantially retain the parallel non-overlapping relation of the 0° fibers during manipulation of the 0° pre-stabilized ply; and c) a thread stitched through the plies to warp/knit the plies together into a structural fabric sheet.

2. The fabric sheet of claim 1 wherein the 0° pre-stabilized ply is located on a lower surface of the sheet.

3. The fabric sheet of claim 1 wherein the 0° pre-stabilized ply is located intermediate an upper ply and a lower ply of said sheet.

4. The fabric sheet of claim 1 further characterized in that said sheet comprises a ply arrangement of at least +45°, $-45°_n$ along with other plies and where n represents a repeating pattern.

5. The fabric sheet of claim 4 wherein the sheet has an odd number of plies and a pattern of angular orientation of the plies from a center one of the plies outward to an outer ply forming an upper surface of the sheet is the same as a pattern of angular orientation of the plies from the center ply outward to an outer ply forming a lower surface of the sheet, such that the sheet has a balanced ply arrangement.

6. The fabric sheet of claim 1 further characterized in that said sheet has at least seven plies with at least one of the plies being a 0° ply.

7. The fabric sheet of claim 1 wherein one of said plies has a fiber areal weight which is different than other of said plies to vary the strength of said fabric sheet in the direction of the fibers of said one of the plies.

8. The fabric sheet of claim 4 wherein the thread comprises one of a glass, carbon, and aramid thread which ties together the plies in said sheet to add damage tolerance.

9. The fabric sheet of claim 1 wherein said sheet comprises a plurality of stacks of multiple plies, each stack having the plies thereof tied together by a thread stitched through the plies to form a separately stitched stack, the separately stitched stacks being stacked atop one another to form the sheet such that a pattern of angular orientation of the plies from a center of the sheet outward to an outer ply forming an upper surface of the sheet is the same as a pattern of angular orientation of the plies from the center of the sheet outward to an outer ply forming a lower surface of the sheet whereby the sheet has a balanced ply arrangement, and wherein the separately stitched stacks are stitched together with a thread.

10. The fabric sheet of claim 1 wherein the fibers in one ply of said sheet comprise fibers of different modulus from fibers in another ply of the sheet to control stiffness of the sheet.

11. A warp/knitted multi-ply structural fabric sheet which is non-woven and non-crimped and capable of being used in structural applications, said fabric sheet being comprised of:

a plurality of plies other than 0° plies disposed upon one another, each ply being formed of parallel non-overlapping fibers laid side-by-side, and the fibers in one of said plies being oriented at an angle to the fibers in one of the other plies;

a 0° ply located in said fabric sheet other than on an upper surface thereof;

one of the plies having a fiber areal weight which is different from the fiber areal weight of another of the plies; and a thread stitched through the plies to warp/knit the plies together into a structural fabric sheet.

12. The fabric sheet of claim 1 wherein the 0° pre-stabilized ply further comprises a tacky resin for adhering the parallel non-overlapping 0° fibers to one another.

13. The fabric sheet of claim 1 wherein the 0° pre-stabilized ply is provided by vertical tricot knitting or stitching through fibers in the 0° ply.

14. A warp/knitted multi-ply relatively thick structural fabric sheet which is non-woven and non-crimped and capable of being used in structural applications, said fabric sheet being comprised of:

a) at least two stacks of plies where each stack has at least three plies each formed of parallel non-overlapping fibers, the plies of each stack being facewise disposed upon one another and stitched through with a thread to form a separately stitched stack, and where certain of said plies have the fibers thereof oriented at an angle different than that of the fibers in certain of the other plies, and at least one of said plies in each stack is a 0° ply and where said at least two stacks are stitched together to form a multi-ply sheet.

15. The fabric sheet of claim 14 further characterized in that said at least one 0° ply is other than an upper ply.

16. The fabric sheet of claim 14 further characterized in that said at least one 0° ply is located on a lower surface of the sheet.

17. The fabric sheet of claim 14 further characterized in that said at least one 0° ply is located intermediate an upper ply and a lower ply of said sheet.

18. The fabric sheet of claim 14 further characterized in that certain of said plies have a weight which is different than other of said plies to vary the mechanical or physical properties of said fabric sheet.

19. The fabric sheet of claim 14 wherein one of a glass, carbon, and aramid thread is stitched through the plies and ties together the plies in said sheet to obtain damage tolerance properties.

20. The fabric sheet of claim 14 further characterized in that one ply of said sheet has a modulus different from the other plies thereof to vary stiffness properties of the sheet.

21. The fabric sheet of claim 14 wherein said fabric sheet is comprised of a plurality of stacks of plies with each stack having at least seven plies to provide a thick sheet.

22. A process for producing a thick multi-ply warp/knitted structural fabric sheet which is non-woven and non-crimped and which sheet can be used in structural applications, said process comprising:

a) applying a plurality of plies to one another in facewise engagement, each ply being formed of parallel non-overlapping fibers laid side-by-side, and where the fibers in at least one of said plies are oriented at an angle to the fibers in other of said plies;

b) forming a 0° pre-stabilized ply by laying fibers side-by-side in parallel and non-overlapping relation in a 0° direction relative to the fibers in the other plies, and joining the 0° fibers to one another by a joining material;

c) applying to the plurality of plies the 0° pre-stabilized ply in a position other than on an upper surface of said fabric sheet; and d) stitching through the plies with a thread to form a warp/knitted structural fabric sheet.

23. The process of claim 22 further characterized in that the process comprises applying said 0° ply on a lower surface of the sheet.

24. The process of claim 22 further characterized in that the process comprises applying said 0° ply intermediate an upper ply and a lower ply of said sheet.

25. The process of claim 22 further characterized in that said process comprises warp/knitting at least seven plies in said plurality of plies.

26. The process of claim 22 further comprising varying the strength of said sheet in a direction of the fibers of one of the plies by varying the fiber areal weight of said one of the plies so as to be different than other of said plies.

27. The process of claim 22 wherein said process comprises knitting the plies together with one of a glass, carbon, and aramid thread through the plies in said sheet.

28. The process of claim 22 further characterized in that said process comprises adding at least one ply to said sheet which has a modulus different than the other plies to thereby alter the stiffness of the sheet.

29. The process of claim 22 further characterized in that the process also comprises knitting together the plurality of plies with one of a glass, carbon, and aramid knit thread to impart damage tolerance.

30. A process for producing a thick multi-ply warp/knitted structural fabric sheet which is non-woven and non-crimped and which can be used in structural applications, said process comprising:

a) applying at least three plies to one another in facewise engagement, each ply being formed of parallel non-overlapping fibers laid side-by-side, and where the fibers in at least certain of said plies are at a different angular relationship than the fibers in others of said plies, and stitching the plies together to form a first fabric stack;

b) applying at least three plies to one another in facewise engagement, each ply being formed of parallel non-overlapping fibers laid side-by-side, and where the fibers in at least certain of said plies are at a different angular relationship than the fibers in others of said plies, and stitching the plies together to form a second fabric stack; and c) warp knitting said two fabric stacks together to form a sheet with at least six plies.

31. The process of claim 30 further characterize that the process comprises:

a) applying to each of the fabric stacks a 0° ply in a position other than on an upper surface of the stack.

32. A process for producing a thick multi-ply warp/knitted structural fabric sheet which is non-woven and non-crimped and which sheet can be used in structural applications, said process comprising:

a) applying at least three plies to one another in facewise engagement and where at least certain of said plies are at a different angular relationship than others of said plies to form a first fabric stack;

b) adding at least one ply to the plurality of plies and which has a different modulus than the other plies to impart higher or lower modulus to the fabric.

33. The process of claim 32 further characterized in that the process comprises applying to the fabric sheet a 0° ply in a position other than on an upper surface of said fabric sheet.

34. The process of claim 33 further characterized in that said process comprises applying a 0° ply on the lower surface of the sheet.

35. The process of claim 33 further characterized in that in applying the plies to one another the process comprises applying certain of said plies with a weight which is different than other of said plies to vary the mechanical properties of said fabric sheet.

36. The process of claim 32 further characterized in that the process comprises forming a plurality of sheets and thereafter stitching or knitting the sheets together in order to form a thick sheet therefrom.

37. A method of producing a spliced warp/knit structural fabric sheet having a width substantially greater than that fabricated on a specified high quality output warp/knit machine subsequently used to produce the fabric with no substantial loss of mechanical properties at a splice joint thereof, said method comprising:

a) warp/knitting a plurality of first plies of a fabric material and where one of the first plies has a width which is less than the other of the plies by a predetermined amount forming an overlap band in the other plies;

b) stacking the first plies together such that the plies with greater width than the ply which has a smaller width provide an overlap with respect to the band having the greater width;

c) warp/knitting a plurality of second plies of a fiber material and where one of the second plies has a width which is smaller than the other of the second plies by a predetermined amount forming an overlap band in the other of the second plies;

d) stacking the second plies together such that the second plies with greater width than the second ply which has a smaller width provide an overlap with respect to the second ply having the greater width;

e) laying the first and second stacks in side by side relationship with one overlap of the first stack being juxtaposed to one overlap of the second stack; and f) introducing the first and second stacks in such side by side relationship into a warp/knit machine and sewing or knitting the same together.

38. The method of claim 37 further characterized in that the method comprises warp/knitting the first plies and the second plies such that the first stack is composed of at least seven plies.

39. The method of claim 37 further characterized in that the method comprises warp/knitting the stacks of first plies and the second plies so that they are spliced together at the edges where they are knitted together.

40. The method of claim 37 further characterized in that each of said stacks are comprised of only three plies.

41. The method of claim 37 further characterized in that each of said stacks is comprised of at least three plies including an upper stack of three plies and at least a lower stack of three plies and a center ply of 90° which are knitted together to make at least a seven ply stack.

42. The method of claim 37 further characterized in that said method comprises warp/knitting three plies of a +45°, −45° and 0° arrangement with the 0° fiber having a width smaller than the 45° fiber, but by a predetermined dimension.

43. The method of claim 42 further characterized in that said stacks are located in a side by side relationship on a knit machine with the overlap of the plies in an area in which a joint is to be formed.

44. An apparatus for producing a thick multi-ply warp/knitted structural fabric sheet which is non-woven and non-crimped and which sheet can be used in structural applications, said apparatus comprising:

a) a moving belt;

b) support pins on said belt;

c) a first ply application station for applying a unidirectional controlled orientation ply of parallel non-overlapping fibers with individual fiber tow tension control to the belt;

d) a plurality of subsequent ply application stations for applying a plurality of plies to one another in facewise multi-axial engagement and where at least one of said plies is at a different angular relationship than other of said plies to form a fabric sheet;

e) a pre-stabilization station for laying fibers in a 0° orientation in parallel non-overlapping relation and joining the fibers together by a joining material to form a 0° pre-stabilized ply;

f) a 0° ply application station for applying the 0° pre-stabilized ply of fibers in facewise engagement with one of the other plies, the 0° ply application station being located between the pre-stabilization station and at least one of the subsequent stations for applying a 0° ply in a position other than on an upper surface of said fabric sheet.

45. The apparatus of claim 44 further characterized in that the 0° ply application station is located before the other stations in the direction of movement of the belt so that a 0° ply is on the lower surface of the sheet.

46. The apparatus of claim 44 further,characterized in that a 0° ply application station is located intermediate the subsequent stations so that a 0° ply is located intermediate an upper ply and a lower ply of said sheet.

47. The apparatus of claim 44 further characterized in that said apparatus comprises seven stations for warp/knitting at least seven plies in said sheet.

48. The apparatus of claim 44 further characterized in that said apparatus comprises eleven stations for warp/knitting at least eleven plies of such sheet.

49. The apparatus of claim 44 further characterized in that at least one of said stations applies certain of said plies with a fiber areal weight which is different than other of said plies thereby varying the mechanical properties of said sheet.

50. The apparatus of claim 44 further characterized in that said apparatus comprises a knitting station for knitting the plies together with a high strength knit thread.

51. The apparatus of claim 44 further characterized in that said apparatus comprises a station for adding fiber of different modulus than other of said stations to control stiffness of the sheet.

52. A warp/knit multi-ply structural fabric sheet which is capable of being used in structural applications and which can be made on a low costs basis, said sheet comprising:

a) at least one ply of a 0° fiber orientation;

b) a plurality of random fibers disposed on said ply of 0° orientation; and c) a third outer ply located on said random fibers and being stitched thereto to form a three layer structural fabric sheet.

53. The warp/knit structural fabric sheet of claim 52 further characterized in that the outer ply is also 0° fibers.

54. The warp/knit structural fabric sheet of claim 53 further characterized in that the first ply is pre-stabilized.

* * * * *

UNITED STATES PATENT AND TRADEMARK OFFICE
CERTIFICATE OF CORRECTION

PATENT NO. : 5,809,805

DATED : September 22, 1998

INVENTOR(S) : Palmer et al.

It is certified that error appears in the above-identified patent and that said Letters Patent is hereby corrected as shown below:

On the title page, item [56]:

In the References Cited, U.S. PATENT DOCUMENTS, add:

| | | |
|---|---|---|
| --3,761,345 | 9/1973 | Smith |
| 4,518,640 | 5/1985 | Wilkens |
| 4,682,480 | 7/1987 | Schnegg |
| 4,787,219 | 11/1988 | Sato et al. |
| 4,872,323 | 10/1989 | Wunner |
| 5,269,863 | 12/1993 | Middleman--. |

Column 24, line 48, after "third" insert --and--.

Signed and Sealed this

Twenty-third Day of February, 1999

*Attest:*

*Attesting Officer*

Q. TODD DICKINSON

*Acting Commissioner of Patents and Trademarks*